United States Patent [19]

Jung

[11] Patent Number: 4,903,514

[45] Date of Patent: Feb. 27, 1990

[54] COMBINED NAIL CLIPPER AND KEY HOLDER

[76] Inventor: Ha Yong Jung, 8534 Harvest View Ct., Ellicott City, Md. 21043

[21] Appl. No.: 380,296

[22] Filed: Jul. 17, 1989

[51] Int. Cl.[4] ..... E05B 29/10

[52] U.S. Cl. ..... 70/456 R

[58] Field of Search ..... 70/456 R, 456 B, 457, 70/458, 459; D28/60; D3/61, 62, 64; 30/143; 24/3 K

[56] References Cited

U.S. PATENT DOCUMENTS

| | | | |
|---|---|---|---|
| D. 202,858 | 11/1965 | Bliss | D28/60 |
| D. 278,369 | 4/1985 | Pringle | D28/60 |
| 3,261,094 | 7/1966 | Bliss | 30/143 |
| 3,267,534 | 8/1966 | Demserau | 70/456 R |

*Primary Examiner*—Robert L. Wolfe

*Attorney, Agent, or Firm*—Birch, Stewart, Kolasch & Birch

[57] ABSTRACT

A combined nail clipper and key holder which comprises a nail clipper housing including a hollow portion provided with a pair of lateral grooves disposed on opposite walls of the housing, the nail clipper housing further including an aperture disposed at the rear end and a key ring connecting member rotatably attached to the front end thereof, a nail clipper having a pair of laterally extending locking pins, the nail clipper being rotatably mounted to the rear end of the nail clipper housing by an end pin which extends into the aperture whereby the nail clipper is rotatable between an inoperative portion where the nail clipper is held in its housing by the functional engagement between the lateral grooves and lateral locking pins and an operative position where the nail clipper is rotated out of the housing about the end pin.

3 Claims, 1 Drawing Sheet

COMBINED NAIL CLIPPER AND KEY HOLDER

BACKGROUND OF THE INVENTION

1. Field of the Invention

The present invention relates to a combined nail clipper and key holder and more particularly, to a nail clipper container pivotably housing a nail clipper therein for readily carrying and easily erecting the nail clipper from the nail clipper container.

2. Description of the Prior Art

Previously, several types of key holders and nail clippers have been separately developed. However, these key holders and nail clippers suffer from a number of difficulties since separate key holders and nail clippers require separate purchases which are expensive, and such separate items occupy a large amount of space in a pocket, a hand bag, or the like. Further, the unavailability of a nail clipper is frequently experienced when traveling.

SUMMARY OF THE INVENTION

Accordingly, it is an object of the present invention to provide a combined nail clipper and key holder which makes readily available the nail clipper for frequent use.

Another object of the present invention is to provide a key holder panel having a hollow portion therein for pivotably housing a nail clipper which can be rotated from the housing for instant use.

A further object of the present invention is to provide a nail clipper container including a key ring for carrying keys and a hollow portion disposed therein defined by a pair of grooves provided on both walls of the hollow portion thereof for slidably locking the nail clipper within the hollow portion through the use of a pair of locking pins expended from the middle portion of an outer cutting jaw member of the nail clipper.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a combined nail clipper and key holder which comprises a nail clipper container, key holder, including hollow portion with a pair of grooves and an aperture disposed at the rear end portion thereof, and a nail clipper having a pair of locking pins for slidably engaging a pair of grooves and an eyelet and a pin for pivotably connecting the nail clipper to the key holder so that the nail clipper can be easily detached from or attached to the nail clipper container.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
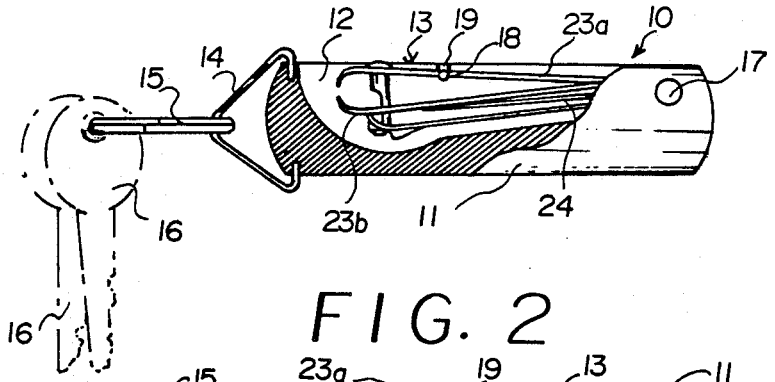
FIG. 1 is a front elevational view of a combined nail clipper and key holder containing cut-away portions in order to illustrate the construction of the device according to the present invention.
Figure 2:
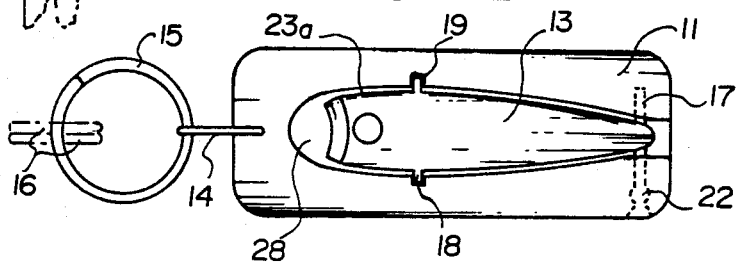
FIG. 2 is a top plan view of the combined clipper and key holder according to the present invention.
Figure 3:
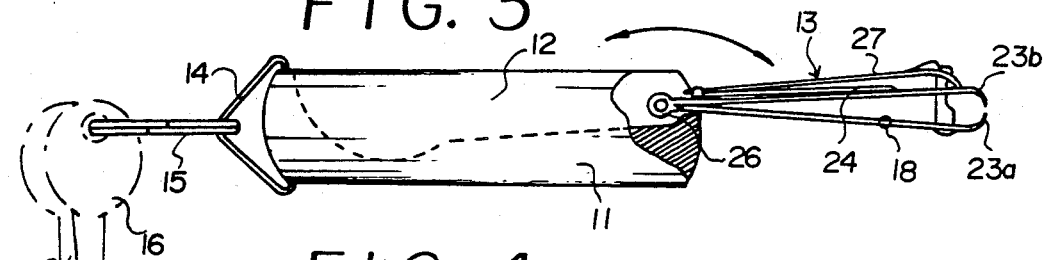
FIG. 3 is a front elevational view of the combined clipper and key holder according to the present invention in erected position.

Referring now in detail to the drawings for the purpose of illustrating the preferred embodiments of the present invention, the combined nail clipper and key holder 10 as shown in FIGS. 1, 2, and 3 comprises a nail clipper 13, a nail clipper container 11 including a hollow portion disposed therein for pivotably receiving the nail clipper 13, and a key ring 15 pivotably connected to the nail clipper container 11 for pivotably holding keys 16.

The nail clipper 13 includes an outer cutting jaw member 23*a*, an inner cutting jaw member 23*b*, an actuating lever 27, a file member, an eyelet 26, and a pair of locking pins 18 which extend from the middle portion of the outer cutting jaw member 23*a*.

Figure 5:
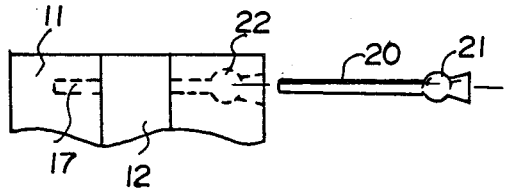
FIG. 5 is a perspective view of a pin operatively associated with an aperture of a nail clipper container according to the present invention.

The nail clipper container 11 further includes an aperture 17, disposed at the rear end thereof, having an enlarged portion 22 disposed at the outside portion thereof for slidably and rotatably receiving a pin 20 having an enlarged portion 21 disposed at the outside portion thereof for mounting the nail clipper 13 to the nail clipper container (FIG. 5). Since the enlarged portion 22 has plastic walls, it will be formed to expand slightly to receive the rigid portion 21.

Figure 4:
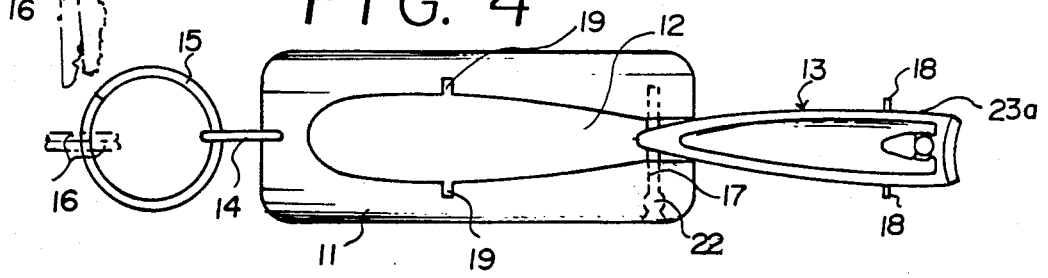
FIG. 4 is a top plan view of FIG. 3.

As shown in FIG. 4, the hollow portion 12 of the nail clipper container 11 includes a pair of locking grooves 19 on both walls thereof for slidably receiving the pair of locking pins 18 of the nail clipper 13. The grooves 19 are slightly smaller than locking pins 18 so that a function fit is established when the pins are forced into the grooves 19.

In assembly, the nail clipper container 11 pivotably containing key 16 through the connecting member 14 and the key ring 15 is assembled with the nail clipper 13 by inserting the pin 20 into the aperture 17 of the nail clipper container 11 through the eyelet 26 of the nail clipper 13.

In operation, when the user desires to use the nail clipper 11 from the combined nail clipper and key holder 10 according to the present invention, the finger is inserted into a space 27 in the vicinity of cutting jaws 23 of the nail clipper 13 and the nail clipper 13 is pulled out in the direction indicated by the arrow from the housed position shown in FIG. 2 to the erected position shown in FIG. 3.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A combined nail clipper and key holder comprising:

a nail clipper housing including a hollow portion provided with a pair of lateral grooves disposed on opposite walls of the housing, said nail clipper housing further including an aperture disposed at the rear end and a key ring connecting member rotatably attached to the front end thereof, a nail clipper having a pair of laterally extending locking pins, said nail clipper being rotatably mounted to the rear end of said nail clipper housing by an end pin which extends into said aperture whereby said nail clipper is rotatable between an inoperative portion where the nail clipper is held in its housing by the functional engagement between the lateral grooves and lateral locking pins and an operative position where the nail clipper is rotated out of the housing about said end pin.

2. The combined nail clipper and key holder of claim 1, wherein the aperture in the nail clipper container has an enlarged portion and the end pin has an enlarged portion whereby when the pin is inserted into the aperture, the aperture expands slightly to receive the end pin.

3. The combined nail clipper and key holder of claim 1, wherein the hollow portion in the nail clipper housing has a nail clipper configuration and further has additional space for inserting the finger to easily pull the nail clipper from the nail clipper housing.

* * * * *